United States Patent [19]

Okamoto et al.

[11] Patent Number: 4,918,275

[45] Date of Patent: Apr. 17, 1990

[54] TURNTABLE FOR ELECTRONIC RANGE

[75] Inventors: Kenzo Okamoto, Osaka; Fumihiko Kitada, Neyagawa, both of Japan

[73] Assignee: Imanashi Kinzoku Kogyo Kabushiki Kaisha, Osaka, Japan

[21] Appl. No.: 317,092

[22] Filed: Feb. 21, 1989

Related U.S. Application Data

[63] Continuation of Ser. No. 66,499, Jun. 26, 1987, abandoned.

[30] Foreign Application Priority Data

Jun. 27, 1986 [JP] Japan ..... 61-149592

[51] Int. Cl.[4] ..... H05B 6/78

[52] U.S. Cl. ..... 219/10.55 F; 219/10.55 E; 126/338; 99/443 R

[58] Field of Search ..... 219/10.55 F, 10.55 E, 219/385, 386, 389; 108/20; 126/338; 99/443 R

[56] References Cited

U.S. PATENT DOCUMENTS 4,424,431 1/1984 Gurubatham ..... 219/10.55 F
4,631,379 12/1986 Aoyama ..... 219/10.55 F
4,694,132 9/1987 Liu ..... 219/10.55 F
4,752,662 6/1988 Takagi ..... 219/10.55 F

FOREIGN PATENT DOCUMENTS 52-33145 3/1977 Japan ..... 219/10.55 F
55-126746 9/1980 Japan ..... 219/10.55 F

*Primary Examiner*—Philip H. Leung
*Attorney, Agent, or Firm*—John J. Byrne

[57] ABSTRACT

A turntable for an electronic range comprises: a tray-supporting element which is provided with a plurality of arms radially arranged and having rollers at end portions thereof, a substantially triangular concave portion at its lower surface, and a through-hole at its central portion; and a coupling unit which is provided with a boss portion received in the through-hole of the tray-supporting element, a substantially triangular flange portion engaged with the concave portion of the tray-supporting element, and a shaft receiving sleeve for receiving a driving shaft of an electric motor, which shaft receiving sleeve is integrally formed in a lower portion of the coupling unit.

1 Claim, 4 Drawing Sheets

TURNTABLE FOR ELECTRONIC RANGE

This application is a continuation, of application Ser. No. 066,499, filed 6/26/87, now abandoned.

BACKGROUND OF THE INVENTION

1. Field of the Invention

The present invention relates to an improvement of a turntable for an electronic range.

2. Description of the Prior Art

Hitherto, various types of turntables for electronic ranges have been proposed for resolving uneven scorching of a food being cooked in the range in which the tray is electrically driven so that the food being cooked on the tray for supporting an object to be heated is uniformly subjected to a high-frequency radio wave or a cooking microwave.

In some of these types of turntables for electronic ranges, the tray is rotatably driven by a roller unit which supports the tray and is connected with a driving shaft of an electric motor so as to transmit a driving torque of the driving shaft of the motor to the.

In the above conventional turntable, it is difficult to conduct an accurate positioning of the with respect to a rotation-supporting element of the unit. In addition, in case that the rotation-supporting element is directly mounted on the driving shaft of the motor, there is often caused unbalanced loading of the driving shaft or a rotary shaft of the motor, which leads to overloading of the motor to shorten the service life thereof. Further, in case that the rotation-supporting element is indirectly mounted on the driving shaft of the motor through a suitable coupling unit, since the rotation-supporting element is formed to be an integral entity, a central portion of the rotation-supporting element is subjected to the cooking microwave of the electronic range in a somewhat concentrated manner so as to be heated to a fairly high temperature, to make it necessary that the rotation-supporting element is made of a material having heat-resisting properties while provided with a complex construction with high dimensional accuracy, which makes the production of the turntable very difficult.

SUMMARY OF THE INVENTION

It is an object of the present invention to provide a novel turntable for an electronic range which may resolve the above difficulty inherent in the conventional turntable for electronic ranges.

According to the present invention, there is provided: In a turntable for an electronic range provided with a cavity or a cooking room in which a tray for supporting an object to be heated is driven by a motor, the improvement wherein said tray is rotatably supported by a rotation-supporting element which is provided with: a plurality of arms radially arranged at its peripheral portion, each of said arms rotatably carrying a roller at its end portion; and a substantially triangular concave portion at its lower surface in a central portion of which is provided a through-hole; and said rotation-supporting element is engaged with a coupling unit provided with: a boss portion inserted into said through-hole of said rotation-supporting element; a substantially triangular flange portion inserted into said concave portion of said rotation-supporting element; and a bearing portion provided in a lower part of said coupling unit, said bearing portion of said coupling unit receiving a driving shaft of a motor, all of said boss, substantially triangular flange and bearing portions forming an integral entity or said coupling unit.

The boss portion of the coupling unit may be provided with at least one slit.

BRIEF DESCRIPTION OF THE DRAWINGS

FIGS. 5 to 7 show the coupling unit, in which:

FIG. 5 is a plan view of the coupling unit;

FIG. 6 is a bottom view of the coupling unit;

FIG. 7 is a sectional view of the coupling unit, taken along the line VII—VII of FIG. 5.

DESCRIPTION OF THE PREFERRED EMBODIMENT

Hereinbelow will be described in detail an embodiment of the present invention with reference to the drawings. It is clearly understood that the present invention is not limited only to the embodiment shown hereinbelow.

Figure 1:
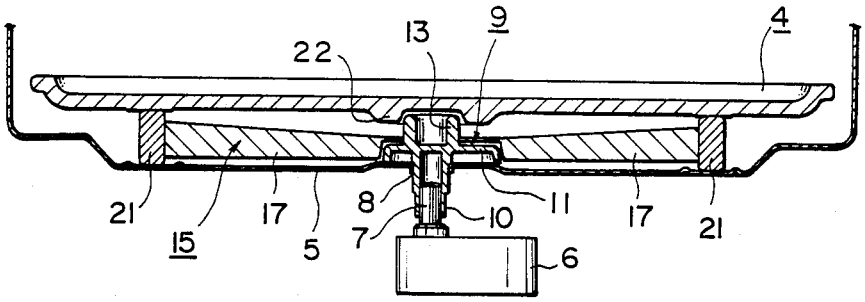
FIG. 1 is a longitudinal sectional view of an essential part of the turntable for the electronic range according to the present invention.
Figure 5:
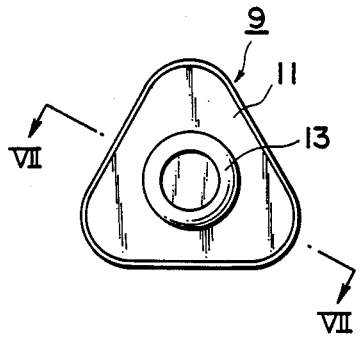
Figure 6:
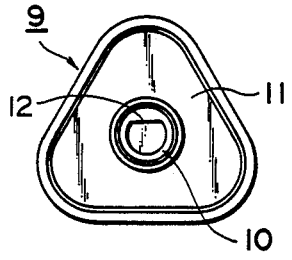
Figure 7:
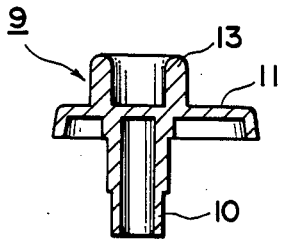
Figure 8:
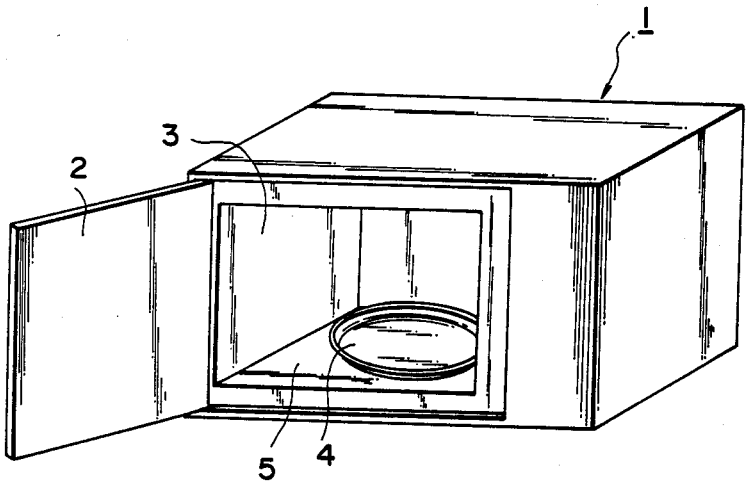
FIG. 8 is a general perspective view of the electronic range of the present invention.

As shown in FIG. 8, in an electronic range provided with a turntable of the present invention, a disk-like tray for supporting an object to be heated 4 made of a heat-resisting glass is disposed on a floor 5 of a cavity or a cooking room 3 of a main body 1 of the range and driven by an electric motor 6 provided in a lower portion of the range at a position below the floor 5 thereof. The cooking room 3 of the range is provided with a door 2. A food to be cooked is placed on the tray 4 and then subjected to a high-frequency radio wave or a cooking microwave issued from a microwave waveguide provided in a ceiling portion of the cooking room 3 of the range so that the food is cooked in the range. As shown in FIG. 1, in a driving unit of the tray 4 of the range, the motor 6 is so installed in the lower portion of the range at the position below the floor 5 thereof that a driving shaft 7 of the motor 6 is arranged to be perpendicular to the floor 5 of the cooking room 3 of the range, an end portion of which driving shaft 7 passes through an opening portion of the floor 5 of the cooking room 3 of the range and properly projects into the cooking room 3. A coupling unit 9 is integrally provided with: a bearing portion 10 fixedly receiving the driving shaft 7 of the motor 6; a flange portion 11; and a boss portion 13. The coupling unit 9 is preferably made of, for example, polyphenylene sulfide resin having heat-resisting properties of at least 200° C. As shown in FIGS. 5 and 6, the flange portion 11 of the coupling unit 9 assumes a substantially equilateral triangular shape with properly rounded corners. The boss portion 13 of the coupling unit 9 assumes a cylindrical shape and is provided in an upper portion of the coupling unit 9 at a position above the flange portion 11 of the same 9 while coaxially arranged with respect to the shaft receiving sleeve 10 of the same 9, to make it possible that the coupling unit 9 is rotatably driven by the driving shaft 7 of the motor 6. In order to transmit a driving torque of the motor 6 for the driving shaft 7 thereof to the coupling unit 9 through the shaft receiving sleeve 10 of the latter 9, the driving shaft 7 of the motor 6 is shaped to assume a D-shaped form in its cross-section, while the shaft receiving sleeve 10 of the coupling unit 9 is shaped to have a hole 12 having a D-shaped cross-section for fixedly receiving the D-shaped driving shaft 7 of the motor 6 therein.

Figure 2:
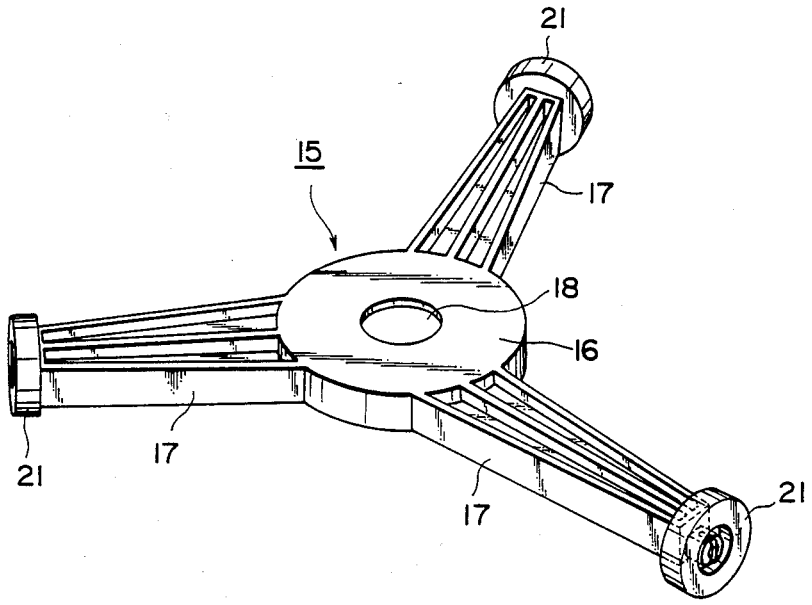
FIG. 2 is a perspective view of the rotation-supporting element employed in the turntable of the present invention shown in FIG. 1.
Figure 3:
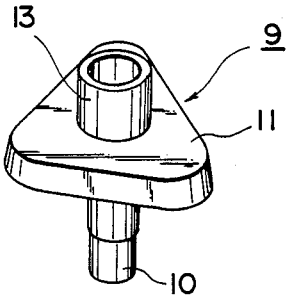
FIG. 3 is a perspective view of the coupling unit employed in the turntable of the present invention shown in FIG. 1.

In FIG. 2, the reference numeral 15 denotes a rotation-supporting element 15 made of, for example, a glass-fiber-reinforced polypropylene resin. The rotation-supporting element 15 is provided with a disk-like body portion 16 and three arm portions 17 which lie in the substantially same plane and is radially extended from the outer peripheral portion of the disk-like body portion 16 while equally spaced apart from each other along the outer peripheral portion of the body portion 16.

Figure 4:
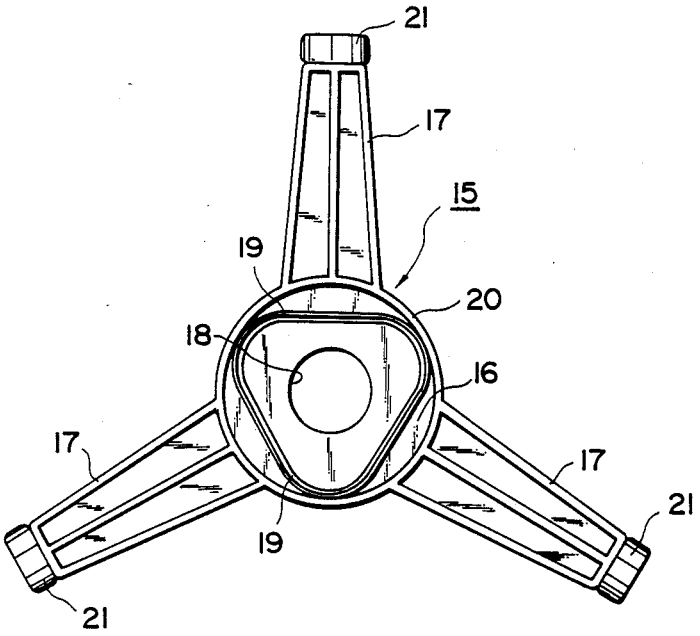
FIG. 4 is a bottom view of the rotation-supporting element shown in FIG. 2.

The disk-like body portion 16 of the rotation-supporting element 15 is provided with a tough-hole 18 at its central portion, through which through-hole 18 is passed the boss portion 13 of the coupling unit 9. As shown in FIG. 4, a rib portion 19 is provided in a lower surface of the disk-like body portion 16 of the rotation-supporting element 15 in a projection manner while accommodated to the outer peripheral shape of the flange portion 11 of the coupling unit 9 so as to be closely fitted to the flange portion 11 of the coupling unit 9 in an insertion manner as shown in FIG. 1. A flange-edge portion 20 is provided in an outer peripheral edge portion of the disk-like body portion 16 of the rotation-supporting element 15 while extended downward.

Three arm portions 17 are provided in the rotation-supporting element 15 so as to radially project outward from the outer periphery of the disk-like body portion 16 of the same 15, which arm portions 17 are circumferentially spaced apart from each other at intervals of 120° C. while arranged perpendicular to the sides of the rib portion 19 of the disk-like body portion 16. Each of such arm portions 17 of the rotation-supporting element 15 rotatably carries a roller 21 made of, for example, a glass-fiber-reinforced Teflon resin.

As shown in FIG. 1, an annular ridge portion 22 is provided in a central portion of a lower surface of the turntable 4, an inner diameter of which ridge portion 22 is slightly larger than the outer diameter of the boss portion 13 of the coupling unit 9.

Such ridge portion 22 of the tray 4 may be replaced with at least three intermittent projections provided at positions corresponding to that of the annular ridge portion 22. In case that these intermittent projections are employed, the number of such intermittent projections is preferably as large as possible. The remaining part of the tray 4 may assume the same configuration as that of the conventional tray and may be made of the material of that of the conventional tray. As shown in FIG. 1, the 4 is thickened at its portion brought into contact with the roller 21 of the rotation-supporting element 15 so as to form an annular thickened portion which is not necessarily required.

As shown in FIG. 1, the diameter of the roller 21, the height of the boss portion 13 of the coupling unit 9 and the height of the ridge portion 22 of the tray 4 are so determined that the lowest point of the ridge portion 22 of the tray 4 reaches a position below the highest point of the boss portion 13 of the coupling unit 9 after assembling thereof. As a result, the boss portion 13 of the coupling unit 9 is received in the ridge portion 22 of the tray 4 in an insertion manner which makes the positioning of the tray 4 easy in the cooking room 3 of the range and prevents the tray 4 from being accidentally disengaged from the the boss portion 22 of the coupling unit 9 in use.

In the electronic range of the present invention, as described in the above, it is possible to easily conduct the positioning of each of the coupling unit 9, rotation-supporting element 15 and the tray 4 in a sure manner in spite of the fact that these three components 9, 15 and 4 are separate members. In addition, it is also possible to transmit the driving torque of the motor 6 to the tray 4 in a sure manner, while it is possible that the motor 6 rotates at a rate of 6 rpm always smoothly.

On the other hand, since the coupling unit 9, rotation-supporting element 15 and the tray 4 are separate members, it is possible to prevent the unbalanced loading of the driving shaft 14 of the motor 6, which leads to a more smooth rotation of the tray 4.

Since these components 9, 15 and 4 are separate members as described above, it is possible to reduce the production cost of the turntable of the electronic range and also possible to produce the same in an easy manner. Since the coupling unit 9 made of a heat-resisting material is employed in the central portion of the rotation-supporting element 15, which central portion is subjected to the cooking microwave in the electronic range in a somewhat concentrated manner so as to be heated to a fairly high temperature, it is possible that the entire of the rotation-supporting element 15 is made of a normal material without employing any of the heat-resisting material. This leads to a considerable reduction of the material cost of the turntable for the electronic range and enables such driving unit to be easily disassembled and/or assembled, which makes it possible to clean the cooking room 3 of the electronic range in an easy and speedy manner.

What is claimed is:

1. A turntable for an electronic range having an oven compartment comprising:

a circular tray member having top and bottom surfaces;

a tray supporting member having a disk-like base with a through hole centrally formed therein and a substantially triangular shaped concave portion formed on the backside thereof;

a plurality of arms joined to said base, each radially extending outward from said base and each provided with a roller at the outer end thereof for rotatably supporting said tray;

a driving motor for turning a drive shaft;

a coupling unit having a shaft sleeve for receiving said drive shaft at the lower end of said coupling unit;

said coupling unit further having an upper coaxial boss portion insertable into said through hole and an intermediate flange portion of substantially triangular shape for mating with said concave portion of said tray supporting member, said flange portion having downwardly tapered peripheral edges;

said tray member being provided centrally on the bottom surface thereof with an annular ridge portion whose inner diameter is slightly larger than outer diameter of said boss portion; and said boss portion having such height that the upper end thereof penetrates inside of the annular ridge portion when said tray member is mounted on said tray supporting member.

* * * * *